US005139173A

United States Patent [19]

Evinger

[11] Patent Number: 5,139,173

[45] Date of Patent: Aug. 18, 1992

[54] BULK PRODUCT DISPENSER

[76] Inventor: Donald J. Evinger, 45W516 Allen Rd., Hampshire, Ill. 60140

[21] Appl. No.: 652,656

[22] Filed: Feb. 8, 1991

[51] Int. Cl.[5] ..... B67D 1/16

[52] U.S. Cl. ..... 222/185; 222/156; 222/556

[58] Field of Search ..... 222/181, 185, 158, 556

[56] References Cited

U.S. PATENT DOCUMENTS

| | | | |
|---|---|---|---|
| 1,011,859 | 12/1911 | Schwartz | 222/556 |
| 1,425,531 | 8/1922 | Mabey | 222/156 X |
| 1,710,119 | 4/1929 | Smith | 222/156 |
| 2,230,460 | 2/1941 | Kleinwachter | 222/156 |
| 2,252,101 | 8/1941 | Tveter | 222/156 X |
| 2,675,947 | 4/1954 | Wynn, Sr. | 222/185 X |
| 2,940,642 | 6/1960 | Strattman | 222/185 X |
| 4,032,048 | 6/1977 | Nichols | 222/185 |
| 4,168,019 | 9/1979 | Hausam | 222/185 |
| 4,401,242 | 8/1983 | Bonomo | 222/556 X |
| 4,562,941 | 1/1986 | Sanfilippo | 222/181 X |

*Primary Examiner*—Robert P. Olszewski
*Assistant Examiner*—James R. Bidwell

[57] ABSTRACT

A bulk foodstuff dispenser with a pivotally mounted chute that dispenses product when manually depressed. A combined product ramp and chute spring takes the form of a flexible plastic plate in a product container area that engages and biases the chute upwardly to its product blocking position. When manually depressed the chute flexes the ramp upwardly above a product stop, permitting product to flow over the stop into the chute. A chute safety lever prevents inadvertent product dispensing and is designed to be operated by the same user's hand that pushes the chute downwardly.

18 Claims, 4 Drawing Sheets

BULK PRODUCT DISPENSER

BACKGROUND OF THE INVENTION

There have been provided in the past a wide variety of bulk product dispensers for retail locations that enable the retail customer to dispense bulk food products such as candy or nuts into a container, in any desired quantity at the wish of the customer. The container is then weighed by the store clerk to determine the price of the product.

Such dispensing units have achieved considerable consumer acceptance in retail stores because of the infinite flexibility the customer has in determining the quantity purchased.

Such product dispensers must have the capabilities of easy trouble-free performance, as well as the ability to instantly initiate and cut off the flow of product from the dispenser.

There have been provided a wide variety of devices that fall into this general category and many have achieved a certain degree of commercial success, but in all cases prior dispensing devices have been inordinately complicated requiring literally dozens of movable parts to achieve the basic dispensing function. That is, in prior devices metal springs, screws, other types of fasteners, metal levers, and other parts have been required to provide an operable dispensing unit. Not only are these dispensing units costly because of the great number of parts required in their manufacture, but these discrete metal parts provide a source of contamination to the food products because of the inherent characteristic of metals to oxidize.

Another problem in prior dispensing devices designed for the consumer retail outlet, is that most can be inadvertently or mischievously actuated by customers or their children.

It is a primary object of the present invention to ameliorate the problems noted above in bulk foodstuff dispensing units.

SUMMARY OF THE PRESENT INVENTION

In accordance with the present invention, a bulk foodstuff product dispenser is provided constructed completely of molded or sheet plastic that requires no metal fasteners, metal springs or metal screws, and eliminates many of the parts heretofore thought necessary in foodstuff product dispensers primarily, but not exclusively, designed for use in dispensing bulk product at retail sales locations. The dispensed foodstuff product may be candy, nuts, beans, coffee beans, pepper corns, popping corn kernels, or a wide variety of other dry foodstuffs having particulate sizes in the range of 0.2 to 2.0 cm., although that range is not intended to be necessarily restrictive of the present invention.

Toward these ends, the present dispenser includes an all plastic container having an angularly related lower wall referred to as a ramp herein that directs product toward an opening in the container or housing that has an inlet chute pivotally mounted for vertical movement between upper and lower positions. When the chute is manually depressed downwardly, product flows from the chute into a user positioned container and when released, automatically shifts upwardly blocking flow from the container.

This ramp that directs product in the container area toward the discharge opening is a flexible plastic sheet that not only serves the ramp function but also biases the chute toward its upper blocking position eliminating the need for metal springs and incident fasteners heretofore thought necessary in such dispensing devices. When the chute is manually depressed, it also flexes this same ramp upwardly above a product stop that permits product to flow over the top of the stop into the chute.

A safety device is provided that prevents inadvertent product dispensing and is designed to be operated by the same user hand that pushes the chute downwardly. This safety device is a simple L-shaped bracket that fits in a slot above the discharge opening. The safety bracket is mounted in the wall of the dispenser immediately above the discharge opening so that the user when pushing the chute down using the fingers of one hand, the back of the same hand can depress the safety to release the chute for dispensing.

Other objects and advantages of the present invention will appear more clearly from the following detailed description.

DETAILED DESCRIPTION OF THE PREFERRED EMBODIMENT

Figure 1:
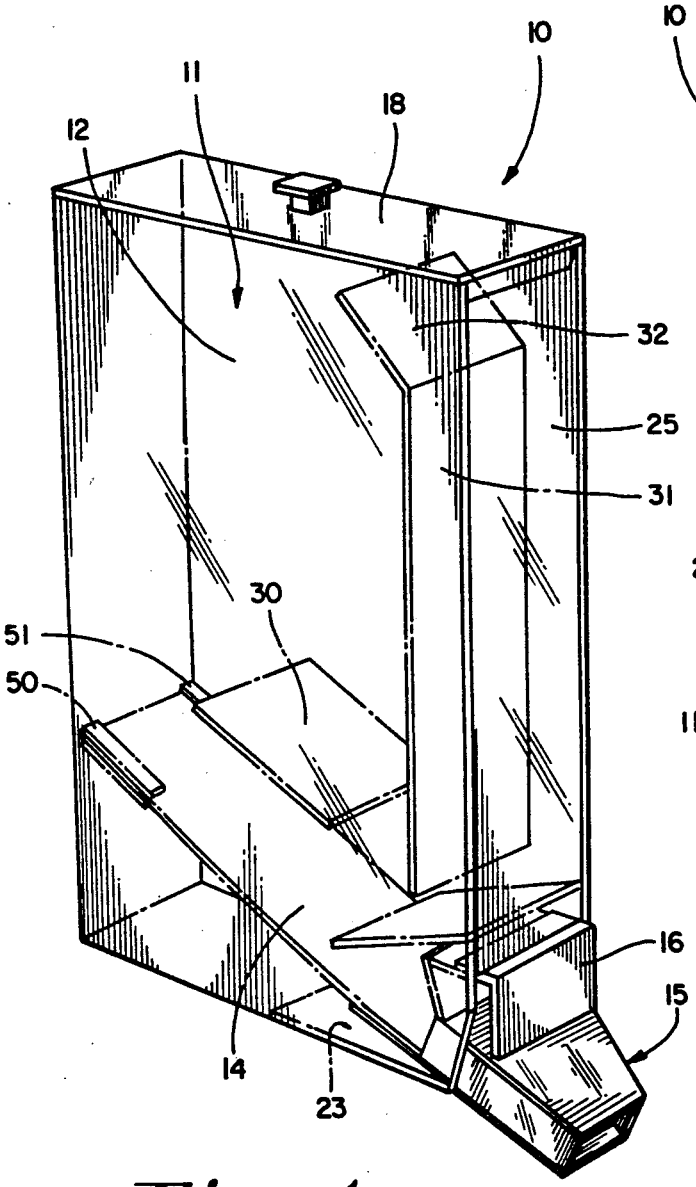
FIG. 1 is a perspective view of the present bulk product dispenser.
Figure 2:
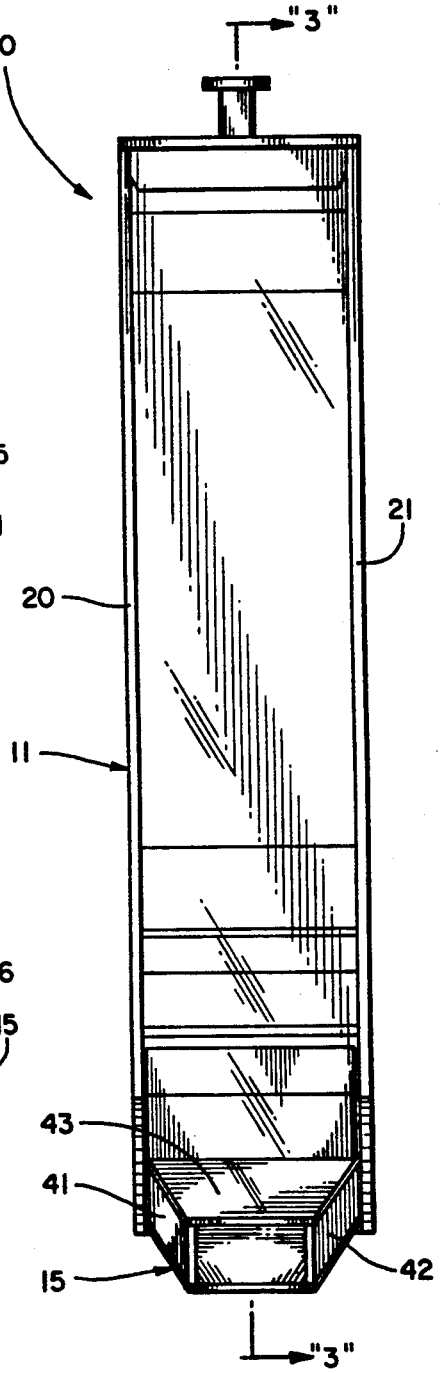
FIG. 2 is an enlarged front view of the product dispenser illustrated in FIG. 1.
Figure 3:
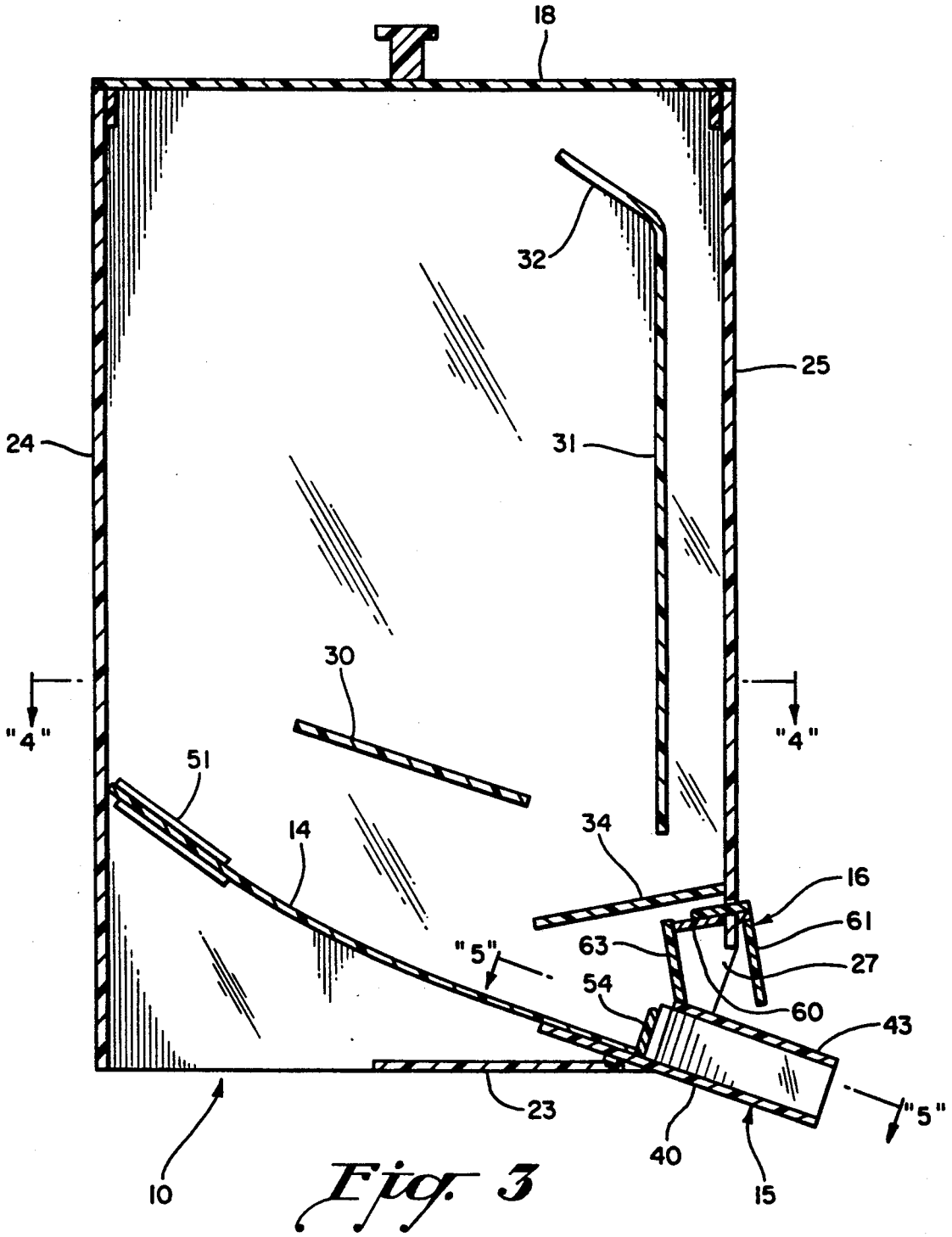
FIG. 3 is a longitudinal section through the entire dispenser taken generally along line 3—3 in FIG. 2.
Figure 4:
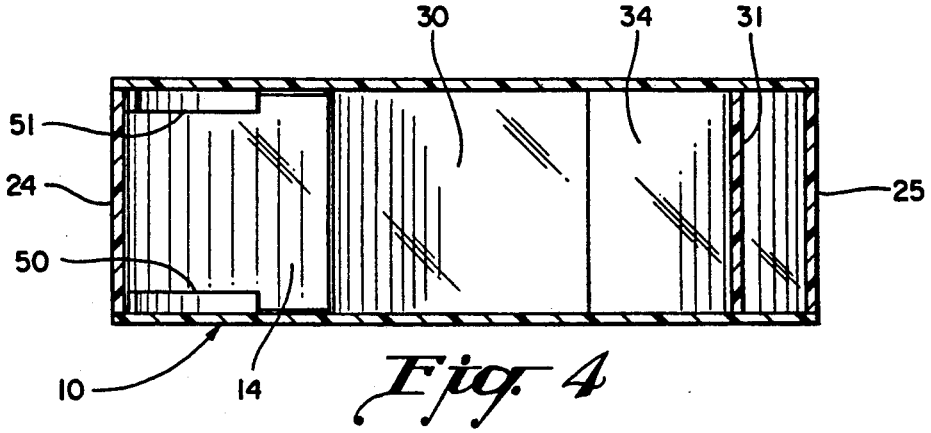
FIG. 4 is a cross-section of the entire dispenser taken generally along line 4—4 in FIG. 3.

Referring to the drawings and particularly FIGS. 1 to 3, a bulk product dispenser 10 is illustrated according to the present invention and as illustrated is constructed entirely of sheet plastic such as acrylic sheeting with a 0.062 to 0.125 inch thickness. It should be understood, however, that many of the parts of the dispenser 10 could be molded in a single molding rather than sheet stock. For example, the basic container with partitions therein could be molded as a single piece without one of its side panels, and the side panel attached thereto by fasteners or gluing. Similarly, the chute could be molded as a single piece as will appear more clearly hereinafter.

The dispenser 10 generally includes a housing 11 that forms a product container storage area 12, a product directing ramp 14, a pivotally mounted dispensing chute 15, a safety device 16, and a removable lid assembly 18. Chute 15 is movable from its product blocking position illustrated in FIGS. 1 to 3 to its product dispensing position illustrated in FIGS. 7 and 9.

The housing 11 includes parallel spaced side walls 20 and 21 interconnected by a partial bottom wall 23, rear wall 24, and front wall 25. The lower end of front wall 25 is truncated to define an opening 27 in the housing 11 that accommodates the chute 15.

Figure 9:
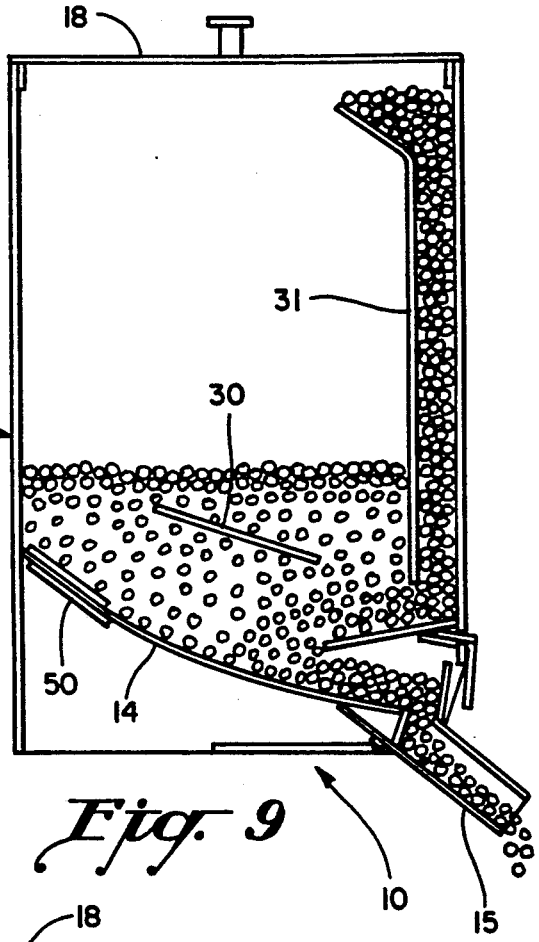

An angularly inclined support platform 3 is fixed between side walls 20 and 21. Platform 30 supports part of the product in container area 12 and removes some of the load from ramp 14. A vertical partition 31 is also fixed between side walls 20 and 21 and has a rearwardly bent upper portion 32 that acts as a deflector for part of the product loaded through top cover 18. A second support platform 34 is fixed between side walls 20 and 21 below partition 31, and it functions to support product between the partition 31 and the front wall 25, or at least support it until the product level falls below the level of partition 31 at which time product between partition 31 and the front wall 25 will be directed by platform 34, which is downwardly and rearwardly inclined, toward ramp 14. As seen in FIG. 9, the partition 31 and the platform 34 provide a full product display from the front of the dispenser 10 even though the container area 12 is only partly filled.

Figure 5:
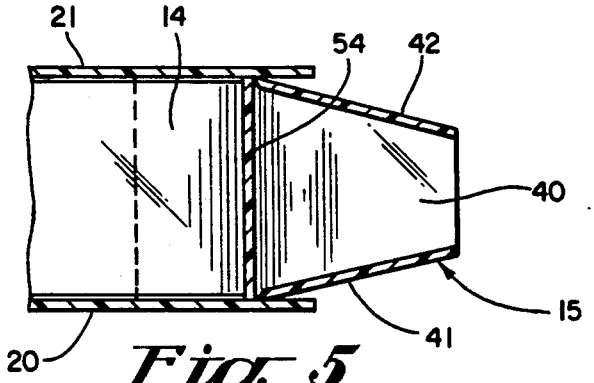
FIG. 5 is a fragmentary cross-section of the chute, looking downwardly, taken generally along line 5—5 of FIG. 3.
Figure 6:
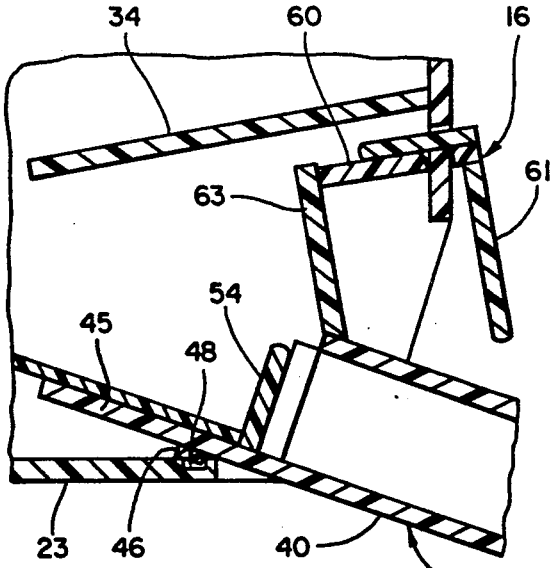
FIG. 6 is a fragmentary longitudinal section showing the chute in its upper blocking position.
Figure 7:
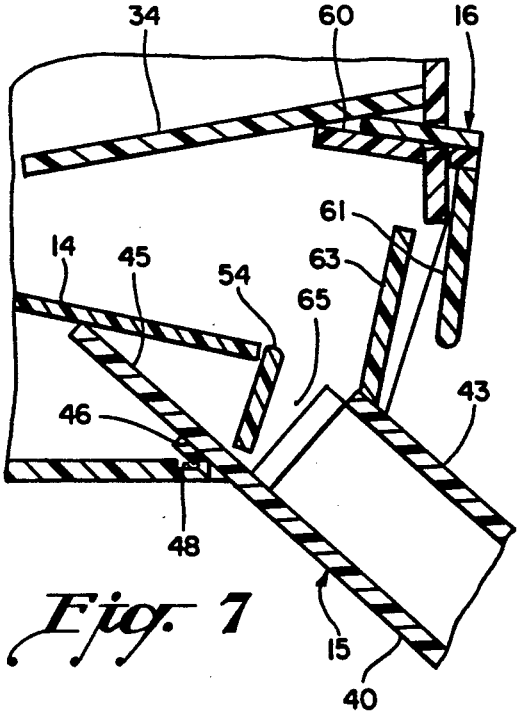
FIG. 7 is a fragmentary longitudinal section similar to FIG. 6 with the chute in its lower dispensing position.

The chute 15 includes a flat bottom wall 40, forwardly converging side walls 41 and 42(see FIG. 5), and a top wall 43. The bottom wall 40 has a rearwardly projecting portion 45 within the housing that has a cross rib 46 fixed thereto that loosely fits within an elongated transverse recess 48 in housing bottom wall 23, as seen in FIGS. 6 and 7, that defines the pivot between the chute 15 and the housing 11 so that the chute 15 is adapted to pivot about a horizontal axis in housing 11. This pivotally interconnection also holds the chute 15 in the housing 11 but at the same time permits the chute's simple removal by merely lifting the ramp 14 upwardly and sliding the chute 15 outwardly from the housing. This makes cleaning the dispenser very simple.

The ramp 14 is also a flexible plastic sheet between walls 20 and 21 but it is not connected to the walls and is held in the housing by a pair of spaced trackways 50 and 51 fixed respectively to the rear of the side walls 20 and 21. The ramp 14 is not bonded to the tracks 50 and 51 so that it can be removed whenever desired for cleaning after the chute 14 is removed and can be easily replaced simply by sliding it back into the tracks 50 and 51.

The forward end of the ramp 14 engages the top of the chute bottom wall portion 45 in a slightly curved position shown in FIG. 3 and thereby acts as a spring biasing the chute 15 in a counter-clockwise direction toward its blocking position shown in FIGS. 3 and 6, for example. In this position a transverse stop 54 fixed between side walls 20 and 21 limits further counter-clockwise movement of the chute 15. Note that the rear of the chute 15 is open so that the stop in the blocking position shown in FIGS. 3 and 6, functions not only as a stop for chute position but also a stop for product flow from the container area 12 into the chute 15.

As seen in FIGS. 3, 6 and 7, the safety device 16 consists essentially of a simple L-shaped bracket having a stop pawl 60 and a downwardly depending operator 61 fixed thereto. Stop pawl 60 engages a cooperating upwardly extending stop projection 63 fixed to the top wall 43 of the chute to prevent the chute from downward movement when the safety is engaged in its FIGS. 3 and 6 positions.

When the safety 16 is rotated clockwise(o inwardly), stop 60 rotates free of the stop projection 63 on the chute 15, and releases the chute, but it is still necessary to manually depress the chute 15 to rotate it to its dispensing position illustrated in FIG. 7.

Figure 8:
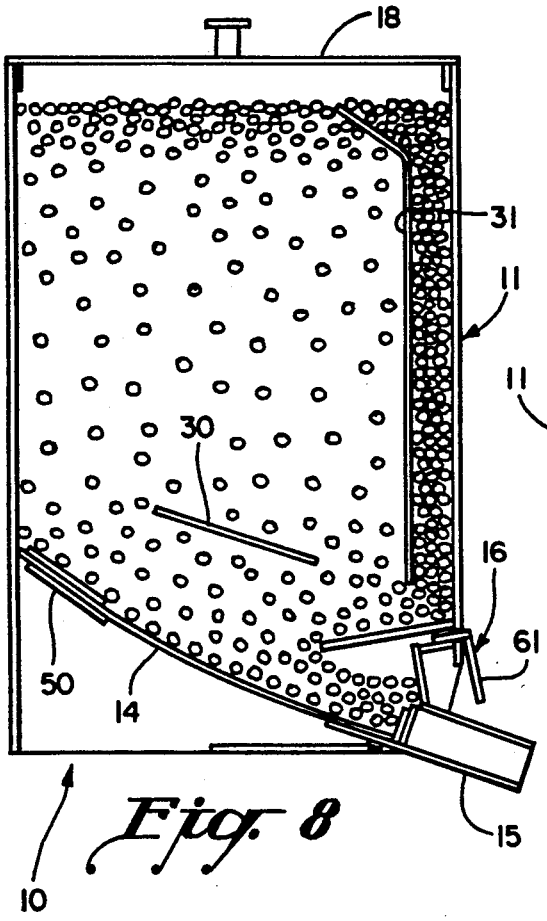
FIGS. 8 to 10 are sequential longitudinal sections of the entire dispenser prior to dispense, during dispense, and after dispense.
Figure 10:
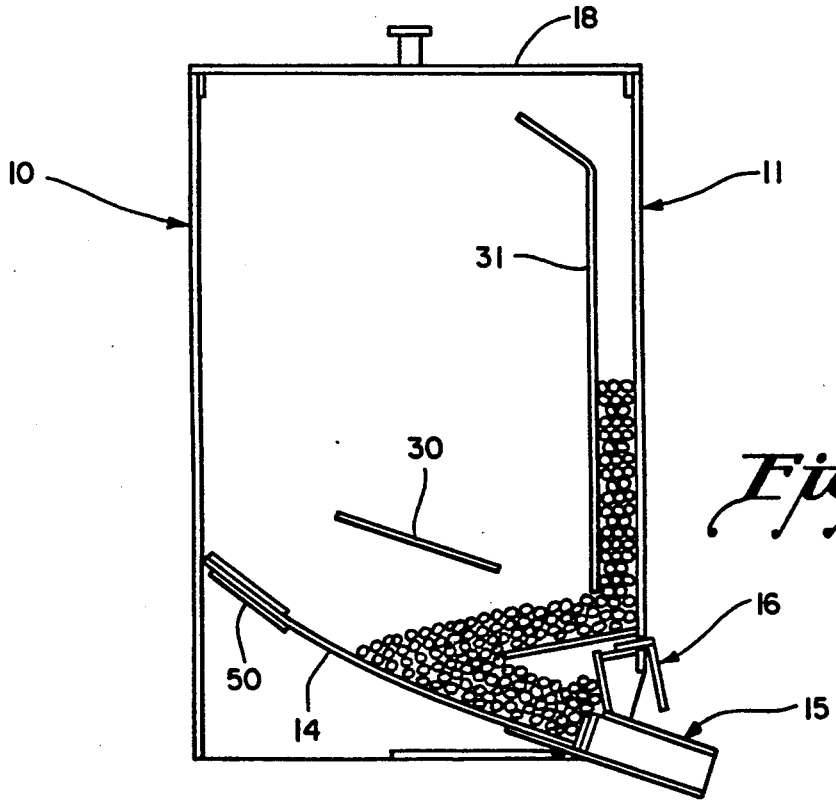

Viewing the sequence of operation of the present dispensing device and with particular but not exclusive reference to FIGS. 8 to 10, the chute 15 is illustrated in its upper blocking position in FIG. 8 with the safety 16 engaged.

Before the customer can depress chute 15, the safety operator 61 must be pushed inwardly but because of its proximity to the top of the chute 15, the back of the user's hand can be used to push on the operator 61 while the fingers of the same hand push and rotate chute 15 downwardly.

As chute 15 is rotated downwardly, the top wall 43 of the chute moves away from the stop 54 providing an opening 65 (see FIG. 7) through which product can flow. At the same time the rearwardly projecting portion 45 of the chute bends the forward end of the ramp 14 upwardly to a position where it is substantially even with the top of the stop 54 permitting product to flow smoothly off the ramp 14 through opening 65 and into the interior of chute 15 from where it is dispensed into the user's container. Thus, the ramp 14 provides the additional function of directing product over the top of the stop 54.

After the customer has dispensed the desired quantity of product, the chute 15 is simply released and it rotates upwardly under the influence of spring ramp 14 until the chute side walls 41 and 42 engage the forward surface of stop 54.

Safety 16 is weighted so that it tends to rotate in a counter-clockwise direction from its position shown in FIG. 7 so that it automatically re-engages as the chute stop projection 63 returns to the FIG. 6 position also illustrated in FIG. 10.

I claim:

1. A continuous flow bulk foodstuff dispenser, comprising: fixed housing means having a container area therein for receiving and holding bulk foodstuff, an opening at one side of the housing through which the foodstuff passes during dispensing, a ramp positioned in the lower portion of the container area for directing foodstuff toward the opening, and a manually operable pivotal dispensing chute positioned at the opening movable from an upper first position blocking foodstuff flow to a lower second position permitting foodstuff to flow continuously from the container area through the chute, and spring means continuously urging the chute toward its front position so that when the chute is manually moved from the first position to the second position and then released the spring means will automatically move the chute back to its first position blocking flow from the container.

2. A bulk foodstuff dispenser as defined in claim 1, wherein the chute is spring biased to its first position blocking flow of foodstuff.

3. A bulk foodstuff dispenser as defined in claim 1, including a stop positioned at the opening in the housing that limits movement of the chute at its first position.

4. A bulk foodstuff dispenser as defined in claim 3, wherein the stop also functions to block flow from the container area into the chute.

5. A bulk foodstuff dispenser as defined in claim 1, including a releasable safety device for preventing movement of the chute from its first position.

6. A bulk foodstuff dispenser, comprising: housing means having a container area therein for receiving and holding bulk foodstuff, an opening at one side of the housing through which the foodstuff passes during dispensing, a ramp positioned in the lower portion of the container area for directing foodstuff toward the opening, and a pivotal dispensing chute positioned at the opening movable from a first position blocking foodstuff flow to a second position permitting foodstuff to flow from the container area through the chute, said chute being spring biased by the ramp, said ramp being vertically flexible to provide its spring characteristics.

7. A bulk foodstuff dispenser as defined in claim 6, wherein the ramp is a plastic member.

8. A bulk foodstuff dispenser, comprising: housing means having a container area therein for receiving and holding bulk foodstuff, an opening at one side of the housing through which the foodstuff passes during dispensing, a ramp positioned in the lower portion of the container area for directing foodstuff toward the opening, and a pivotal dispensing chute positioned at the opening movable from a first position blocking foodstuff flow to a second position permitting foodstuff to flow from the container area through the chute, including a releasable safety device for preventing movement of the chute from its first position, said safety device being pivotally mounted at the opening just above the chute so the safety device and the chute can be manually actuated by one hand of the user.

9. A bulk foodstuff dispenser, comprising: housing means having a container area therein for receiving and holding bulk foodstuff, an opening at one side of the housing through which the foodstuff passes during dispensing, a ramp positioned in the lower portion of the container area for directing foodstuff toward the opening, and a pivotal dispensing chute positioned at the opening movable from a first position blocking foodstuff flow to a second position permitting foodstuff to flow from the container area through the chute, said ramp being vertically flexible and having one end thereof in engagement with the chute to bias the chute toward its first position.

10. A bulk foodstuff dispenser as defined in claim 9, including a stop positioned at the opening in the housing that limits movement of the chute at its first position, the stop also functioning to block flow from the container area into the chute, said one end of the ramp being substantially vertically aligned with the top of the stop in the second position of the chute to permit flow of product over the stop and through the chute.

11. A bulk foodstuff dispenser as defined in claim 9, including a releasable safety device for preventing movement of the chute from its first position, the safety device being pivotally mounted at the opening just above the chute so the safety device and the chute can be manually actuated by one hand of the user.

12. A bulk foodstuff dispenser, comprising: housing means having a container area therein for receiving and holding bulk foodstuff, an opening at one side of the housing through which the foodstuff passes during dispensing, a ramp positioned in the lower portion of the container area for directing foodstuff toward the opening, a pivotal dispensing chute positioned at the opening movable from a first position blocking foodstuff flow to a second position permitting foodstuff to flow from the container area through the chute, said chute having an entrance opening at one end directly adjacent the opening in the housing and a discharge opening at its other end, and a fixed stop positioned at the opening in the housing that limits movement of the chute at its first position, the stop also functioning to block flow from the container area into the chute, said stop being sized to cover the entrance opening in the chute in its first position.

13. A bulk foodstuff dispenser, comprising: housing means having a container area therein for receiving and holding bulk foodstuff, an opening at one side of the housing through which the foodstuff passes during dispensing, a ramp positioned in the lower portion of the container area for directing foodstuff toward the opening, a pivotal dispensing chute positioned at the opening movable from a first position blocking foodstuff flow to a second position permitting foodstuff to flow from the container area through the chute, and a stop positioned at the opening in the housing that limits movement of the chute at its first position, the stop also functioning to block flow from the container area into the chute, said ramp being vertically flexible and having one end thereof in engagement with the chute to bias the chute toward its first position.

14. A bulk foodstuff dispenser, comprising: housing means having a container area therein for receiving and holding bulk foodstuff, an opening at one side of the housing through which the foodstuff passes during dispensing, a ramp positioned in the lower portion of the container area for directing foodstuff toward the opening, a pivotal dispensing chute positioned at the opening movable from a first position blocking foodstuff flow to a second position permitting foodstuff to flow from the container area through the chute, and a stop positioned at the opening in the housing that limits movement of the chute at its first position, the stop also functioning to block flow from the container area into the chute, and a releasable safety device for preventing movement of the chute from its first position, the safety device being pivotally mounted at the opening just above the chute so the safety device and the chute can be manually actuated by one hand of the user.

15. A bulk foodstuff dispenser, comprising: housing means having a container area therein for receiving and holding bulk foodstuff, an opening at one side of the housing through which the foodstuff passes during dispensing, a ramp positioned in the lower portion of the container area for directing foodstuff toward the opening, a pivotal dispensing chute positioned at the opening movable from a first position blocking foodstuff flow to a second position permitting foodstuff to flow from the container area through the chute, and a releasable safety device for preventing movement of the chute from its first position, the safety device being pivotally mounted at the opening just above the chute so the safety device and the chute can be manually actuated by one hand of the user.

16. A bulk food dispenser as defined in claim 15, said ramp being vertically flexible and having one end thereof in engagement with the chute to bias the chute toward its first position.

17. A bulk food dispenser as defined in claim 15, including a stop positioned at the opening in the housing that limits movement of the chute at its first position.

18. A bulk foodstuff dispenser, comprising: housing means having a container area therein for receiving and holding bulk foodstuff, an opening at one side of the housing through which the foodstuff passe during dispensing, a ramp positioned in the lower portion of the container area for directing foodstuff toward the opening, a pivotal dispensing chute positioned at the opening movable from a first position blocking foodstuff flow to a second position permitting foodstuff to flow from the container area through the chute, said ramp being vertically flexible and having one end thereof in engagement with the chute to bias the chute toward its first position, a stop positioned at the opening in the housing that limits movement of the chute at its first position, the stop also functioning to block flow from the container area into the chute, and a releasable safety device for preventing movement of the chute from its first position, the safety device being pivotally mounted at the opening just above the chute so the safety device and the chute can be manually actuated by one hand of the user, said one end of the ramp being substantially vertically aligned with the top of the stop in the second position of the chute to permit flow of product through the chute.

* * * * *